US007380920B2

(12) United States Patent
Sonnichsen et al.

(10) Patent No.: US 7,380,920 B2
(45) Date of Patent: Jun. 3, 2008

(54) INK JET APPARATUS

(75) Inventors: Brian E. Sonnichsen, Portland, OR (US); James D. Padgett, Lake Oswego, OR (US); Sharon S. Berger, Canby, OR (US); Ronald F. Burr, Richmond, VA (US); David W. Hanks, Forest Grove, OR (US)

(73) Assignee: Xerox Corporation, Norwalk, CT (US)

( * ) Notice: Subject to any disclaimer, the term of this patent is extended or adjusted under 35 U.S.C. 154(b) by 277 days.

(21) Appl. No.: 10/930,064

(22) Filed: Aug. 30, 2004

(65) Prior Publication Data

US 2006/0044365 A1 Mar. 2, 2006

(51) Int. Cl.
*B41J 2/17* (2006.01)

(52) U.S. Cl. ..... 347/84

(58) Field of Classification Search ..... 347/89, 347/84, 85

See application file for complete search history.

(56) References Cited

U.S. PATENT DOCUMENTS

| | | | | |
|---|---|---|---|---|
| 4,380,770 | A * | 4/1983 | Maruyama | 347/29 |
| 4,527,175 | A * | 7/1985 | Kojima et al. | 347/85 |
| 4,558,326 | A * | 12/1985 | Kimura et al. | 347/30 |
| 4,998,120 | A * | 3/1991 | Koto et al. | 347/70 |
| 5,485,187 | A * | 1/1996 | Okamura et al. | 347/85 |
| 6,152,559 | A * | 11/2000 | Kojima | 347/89 |
| 6,276,790 | B1 * | 8/2001 | Ikezaki | 347/88 |
| 6,315,402 | B1 * | 11/2001 | Kawase | 347/85 |
| 6,450,627 | B1 * | 9/2002 | Moynihan et al. | 347/71 |
| 2001/0020968 | A1 * | 9/2001 | Isono et al. | 347/71 |

* cited by examiner

*Primary Examiner*—An H Do
(74) *Attorney, Agent, or Firm*—Manuel Quiogue

(57) ABSTRACT

A container including a first tank for receiving a liquid, a second tank that is selectively pressurizable, a check valve for permitting fluid flow from the first tank to the second tank, and a manifold structure having a first port fluidically coupled to the first tank and a second port fluidically coupled to the second tank.

4 Claims, 5 Drawing Sheets

INK JET APPARATUS

BACKGROUND

The subject disclosure is generally directed to drop emitting apparatus.

Drop on demand ink jet technology for producing printed media has been employed in commercial products such as printers, plotters, and facsimile machines. Generally, an ink jet image is formed by selective placement on a receiver surface of ink drops emitted by a plurality of drop generators implemented in a printhead or a printhead assembly. For example, the printhead assembly and the receiver surface are caused to move relative to each other, and drop generators are controlled to emit drops at appropriate times, for example by an appropriate controller. The receiver surface can be a transfer surface or a print medium such as paper. In the case of a transfer surface, the image printed thereon is subsequently transferred to an output print medium such as paper. Some ink jet printheads employ melted solid ink.

It can be difficult to reduce bubbles in the ink provided to the drop generators.

DETAILED DESCRIPTION

Figure 1:
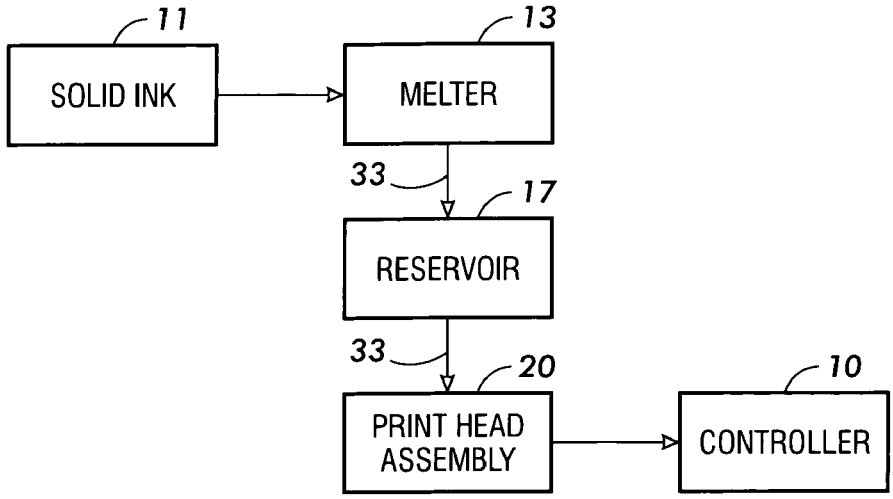
FIG. 1 is a schematic block diagram of an embodiment of an ink jet printing apparatus.

FIG. 1 is a schematic block diagram of an embodiment of a printing system that includes a supply of solid ink 11 which provides solid ink to a solid ink melter 13. The solid ink melter 13 provides melted solid ink 33 to an ink reservoir 17 which supplies melted solid ink 33 to a printhead assembly 20 that can include a plurality of drop emitting drop generators 30 (FIG. 2) for emitting drops of ink, for example. By way of illustrative example, the ink reservoir 17 can be attached to the printhead assembly 20 or integral therewith.

A controller 10 selectively energizes the drop generators of the printhead assembly 20 by providing a respective drive signal to each drop generator of the printhead assembly 20. Each of the drop generators can employ a piezoelectric transducer. As other examples, each of the drop generators can employ a shear-mode transducer, an annular constrictive transducer, an electrostrictive transducer, an electromagnetic transducer, or a magnetorestrictive transducer. The printhead assembly 20 can be formed of a stack of laminated sheets or plates, such as of stainless steel, having suitable openings formed therein, for example.

Figure 2:
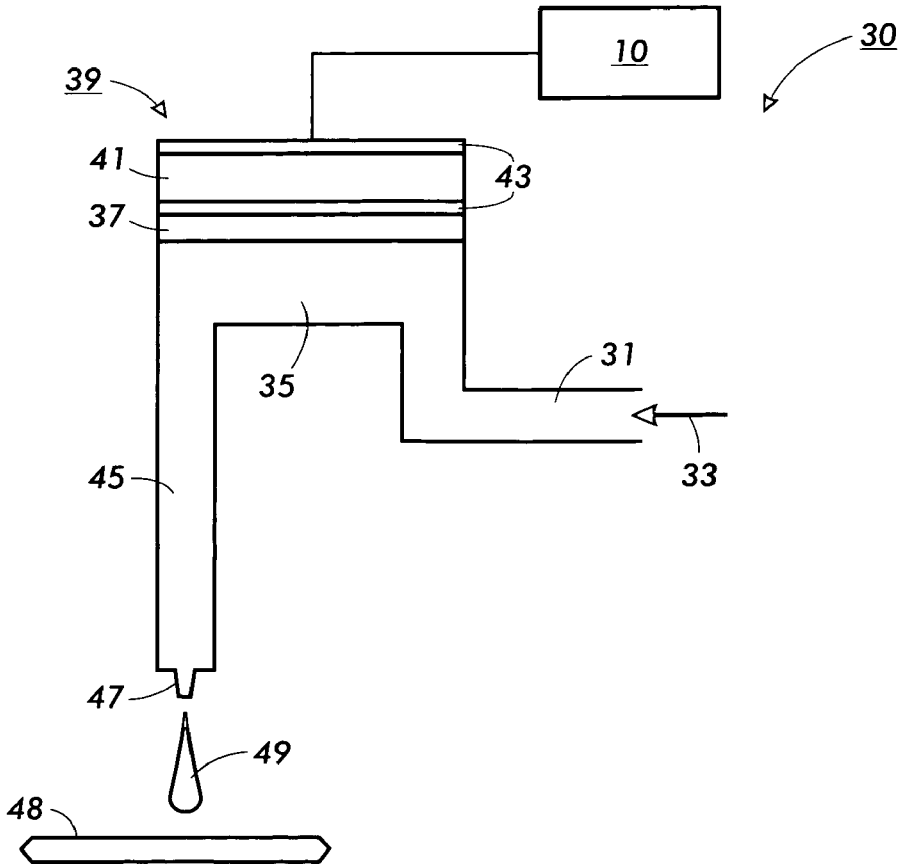
FIG. 2 is a schematic block diagram of an embodiment of a drop generator that can be employed in the printhead of the ink jet printing apparatus shown in FIG. 1.

FIG. 2 is a schematic block diagram of an embodiment of a drop generator 30 that can be employed in the printhead assemblies 20 of the printing apparatus shown in FIG. 1. The drop generator 30 includes an inlet channel 31 that receives melted solid ink 33 from a manifold, reservoir or other ink containing structure. The melted ink 33 flows into a pressure or pump chamber 35 that is bounded on one side, for example, by a flexible diaphragm 37. An electromechanical transducer 39 is attached to the flexible diaphragm 37 and can overlie the pressure chamber 35, for example. The electromechanical transducer 39 can be a piezoelectric transducer that includes a piezo element 41 disposed for example between electrodes 43 that receive drop firing and non-firing signals from the controller 10. Actuation of the electromechanical transducer 39 causes ink to flow from the pressure chamber 35 to a drop forming outlet channel 45, from which an ink drop 49 is emitted toward a receiver medium 48 that can be a transfer surface or a print output medium, for example. The outlet channel 45 can include a nozzle or orifice 47.

Figure 3:
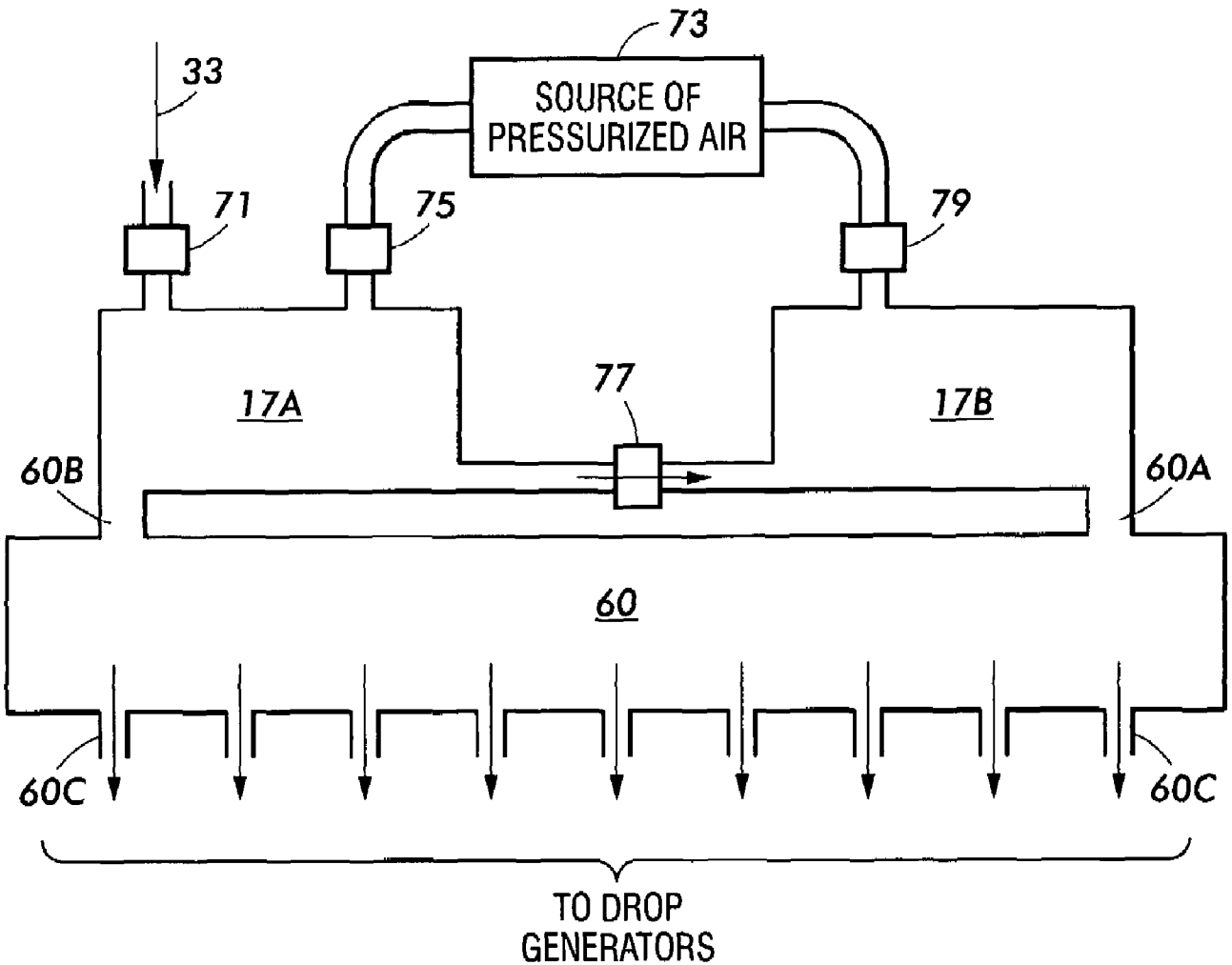
FIG. 3 is a schematic block diagram of an embodiment of a recirculating ink delivery system that can be employed in the printing apparatus of FIG. 1.

FIG. 3 is a schematic block diagram of an embodiment of a recirculating ink delivery system that can be employed in the printing apparatus of FIG. 1. The recirculating ink delivery system includes a first tank 17A that receives ink 33 through a valve 71, for example. The first tank 17A can be selectively pressurized, for example by controllably introducing pressurized air from a source of pressurized air 73 through a valve 75.

The recirculating ink delivery system further includes a second ink tank 17B that receives ink from the first tank 17A via a check valve 77 that permits flow only from the first tank 17A to the second tank 17B. The second tank 17B is selectively pressurizable, for example by controllably introducing pressurized air from the source of pressurized air 73 via a valve 79.

The second tank 17B is fluidically coupled to an input port 60A of a manifold structure 60, while the first ink tank 17A is fluidically coupled to an output port 60B of the manifold structure 60.

Figure 4:
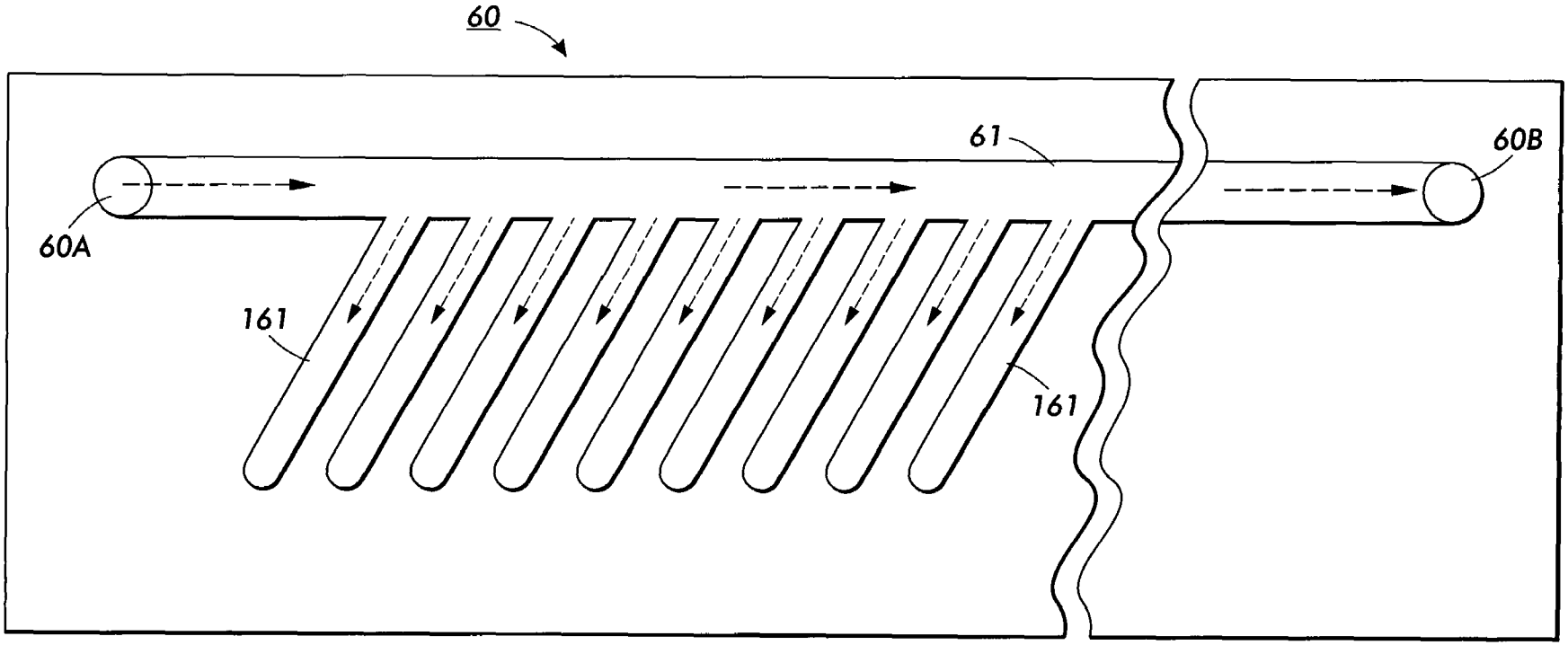
FIG. 4 is a schematic block diagram of an embodiment of a manifold structure that can be employed in the recirculating ink delivery system of FIG. 3.
Figure 5:
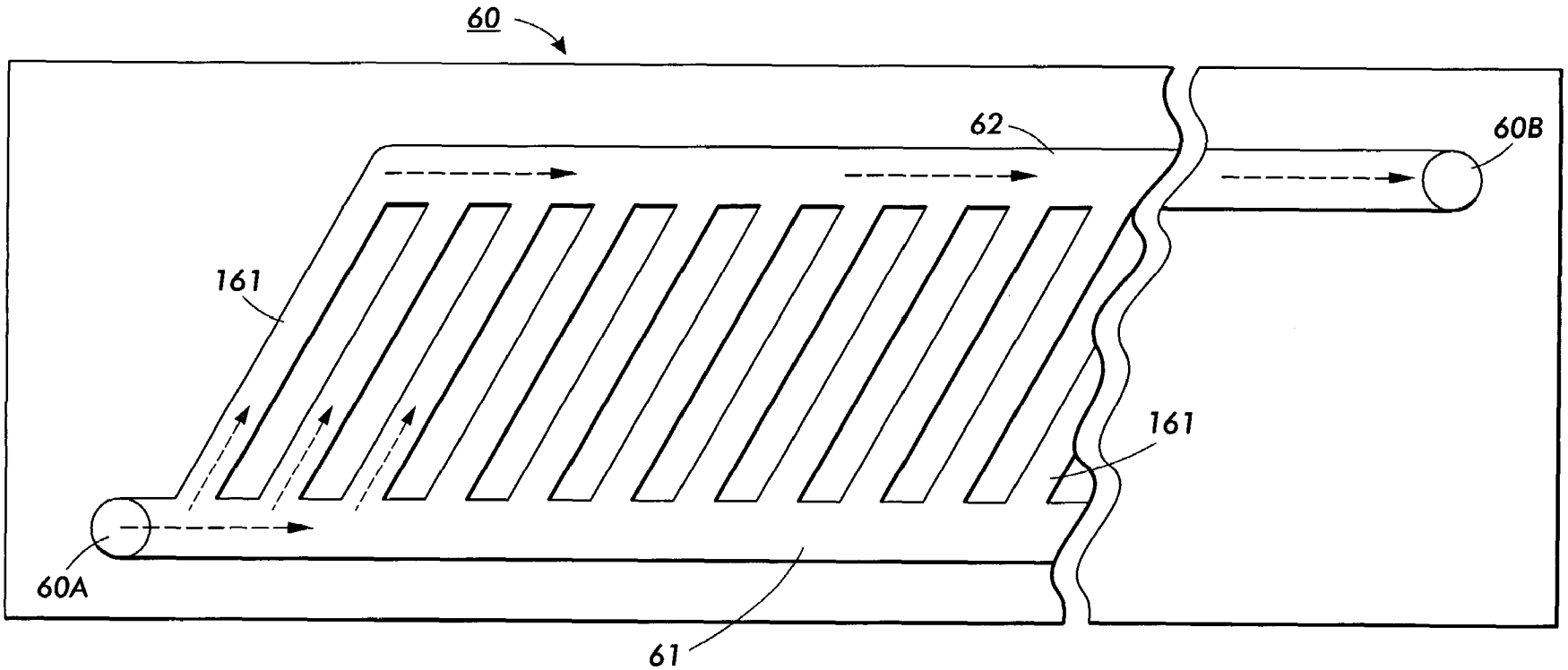
FIG. 5 is a schematic block diagram of an embodiment of another manifold structure that can be employed in the recirculating ink delivery system of FIG. 3.

The manifold structure 60 further includes a plurality of outlets 60C that provide ink to drop generators, for example via intermediate finger manifolds 161 (FIGS. 4 and 5).

The manifold structure 60 can be implemented in the printhead assembly 20 along with the drop generators 30 and the fluidic connections between the manifold structure 60 and the drop generators 30. As described earlier, the printhead assembly 20 can comprise for example a stack of laminated sheets or plates. The first tank 17A and the second tank 17B can be attached to the printhead assembly, for example.

In normal printing operation, the first tank 17A and the second tank 17B are both vented to atmosphere, and ink 33 is appropriately introduced into the first tank 17A. Since both tanks are vented to atmosphere, ink will flow into the second tank 17B until the ink levels in both tanks 17A, 17B are substantially equalized. Ink can flow from either tank into the manifold structure 60, which in turn feeds the drop generators.

The ink in the second tank 17B can be recirculated, for example to reduce bubbles in the ink. With the ink in the tanks at a level that is less than full, for example at about half full, the second tank 17B is pressurized while the first tank is vented to atmosphere. This closes the check valve 77 which prevents ink from flowing to the second ink tank 17B, and causes ink to flow from the second tank 17B to the manifold structure. This in turn causes ink to flow from the manifold structure 60 to the first tank 17A where ink accumulates. When the first tank 17A is full or when the second tank 17B is nearly empty, for example, the second tank 17B is vented to atmosphere, which allows the ink levels to be generally equalized in the first and second tanks 17A, 17B. After the ink levels are generally equalized, the foregoing transfer can be repeated, as appropriate. In this manner, the second tank 17B comprises a source tank and the first tank comprises a sink tank, wherein ink is transferred from the source tank to the manifold structure 60, and ink is transferred from the manifold structure 60 to the sink tank.

Purging can be accomplished for example by pressurizing the first tank 17A and the second tank 17B, which forces ink to flow from the manifold to the drop generators.

FIG. 4 is a schematic illustration of an embodiment of a manifold structure 60 that can be employed in the recirculating ink delivery system of FIG. 3. The manifold structure 60 includes an elongated primary manifold 61 and a plurality of finger manifolds 161 fluidically connected thereto. An input port 60A and an output port 60B can be located at longitudinally separated end portions of the primary manifold 61. Recirculation flow is from the input port into the primary manifold, and from the primary manifold to the output port.

Figure 6:
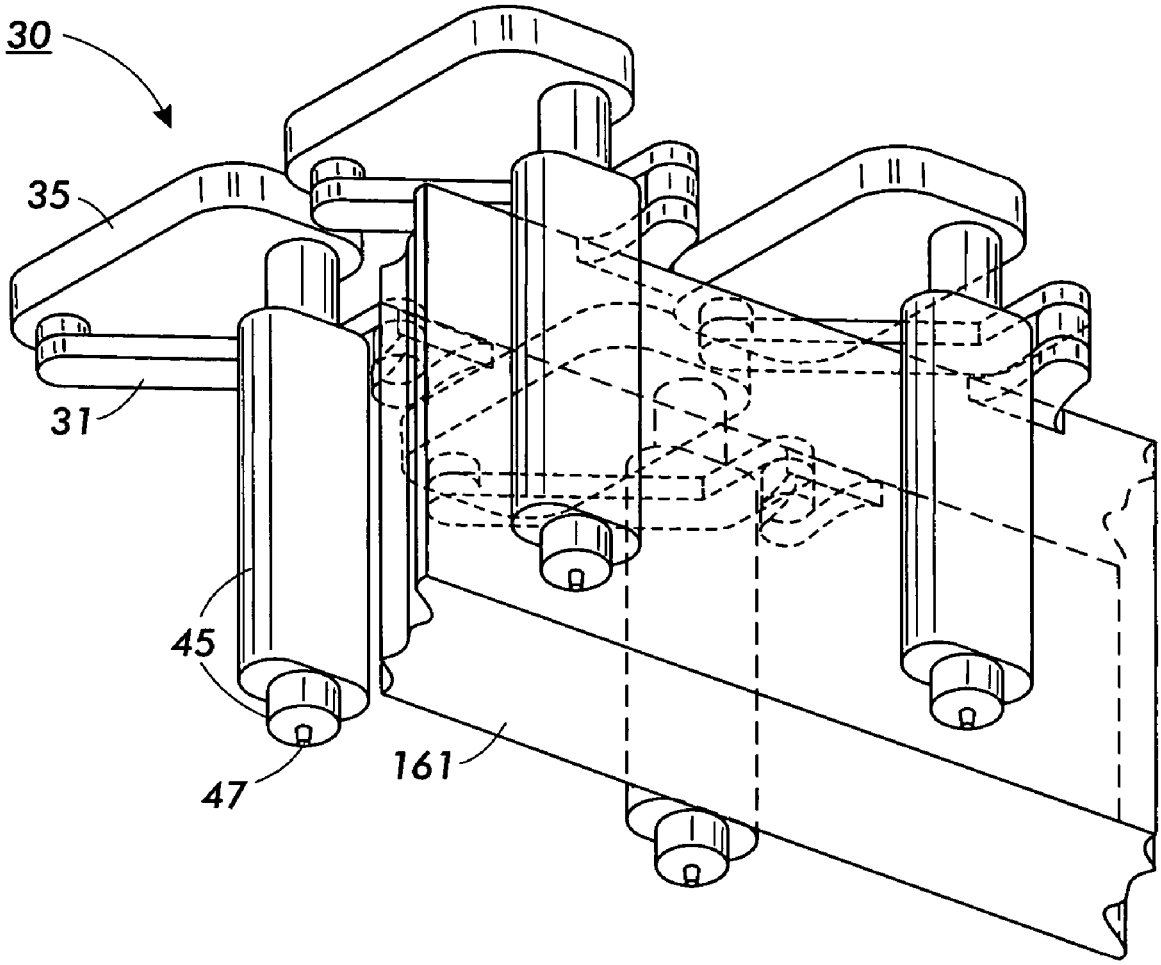
FIG. 6 is a schematic isometric view generally illustrating a plurality of ink drop generators that are fluidically coupled to a finger manifold of the manifold structure of FIG. 4 or FIG. 5.

A plurality of ink drop generators 30 can be fluidically connected to each finger manifold, as schematically depicted in FIG. 6.

FIG. 5 is a schematic illustration of an embodiment of another manifold structure 60 that can be employed in the recirculating ink delivery system of FIG. 3. The manifold structure 60 includes a first elongated primary manifold 61 and a second elongated primary manifold 62 transversely separated from the first elongated primary manifold 61. A plurality of finger manifolds 161 are fluidically connected between the first primary manifold 61 and the second primary manifold 62. An input port 60A can be located at one end portion of the first primary manifold 61, while an output port 60B can be located at one end portion of the second primary manifold 62, for example at an end portion that is farthest from the input port 60A. Recirculation flow is from the input port into the first primary manifold 61, from the first primary manifold 61 into the finger manifolds 161, from the finger manifolds 161 into the second primary manifold 62, and from the second primary manifold 62 to the output port 60B.

A plurality of ink drop generators 30 can be fluidically connected to each finger manifold, as schematically depicted in FIG. 6.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A printing apparatus comprising:

a first tank for receiving ink;

a second tank that is selectively pressurizable;

a check valve for permitting ink flow from the first tank to the second tank;

a manifold structure having a first port fluidically coupled to the first tank and a second port fluidically coupled to the second tank, wherein the manifold structure comprises a primary manifold and a plurality of finger manifolds connected to the primary manifold;

whereby the check valve closes and ink flows from the second tank to the manifold and then from the manifold to the first tank when the second tank is pressurized to a higher pressure than the first tank; and a plurality of drop generators fluidically coupled to the plurality of finger manifolds of the manifold structure.

2. A printing apparatus comprising:

a first tank for receiving ink;

a second tank that is selectively pressurizable;

a check valve for permitting ink flow from the first tank to the second tank;

a manifold structure having a first port fluidically coupled to the first tank and a second port fluidically coupled to the second tank;

whereby the check valve closes and ink flows from the second tank to the manifold and then from the manifold to the first tank when the second tank is pressurized to a higher pressure than the first tank; and a plurality of drop generators fluidically coupled to the manifold structure, wherein the plurality of drop generators are implemented in a laminar stack of metal plates.

3. A printing apparatus comprising:

a first tank for receiving ink;

a second tank that is selectively pressurizable;

a check valve for permitting ink flow from the first tank to the second tank;

a manifold structure having a first port fluidically coupled to the first tank and a second port fluidically coupled to the second tank;

whereby the check valve closes and ink flows from the second tank to the manifold and then from the manifold to the first tank when the second tank is pressurized to a higher pressure than the first tank; and a plurality of drop generators fluidically coupled to the manifold structure;

wherein the manifold structure and the plurality of drop generators are implemented in a laminar stack of metal plates.

4. A printing apparatus comprising:

a first tank for receiving melted solid ink;

a second tank that is selectively pressurizable;

a check valve for permitting ink flow from the first tank to the second tank;

a manifold structure having a first port fluidically coupled to the first tank and a second port fluidically coupled to the second tank;

whereby the check valve closes and ink flows from the second tank to the manifold and then from the manifold to the first tank when the second tank is pressurized to a higher pressure than the first tank; and a plurality of drop generators fluidically coupled to the manifold structure.

* * * * *